US005090696A

United States Patent [19]

Forrest, Sr.

[11] Patent Number: 5,090,696

[45] Date of Patent: Feb. 25, 1992

[54] POP-UP TACKLING PRACTICE MACHINE

[75] Inventor: Charles P. Forrest, Sr., Mobile, Ala.

[73] Assignee: Charles P. Forrest, Jr., Mobile, Ala.; a part interest

[21] Appl. No.: 652,776

[22] Filed: Feb. 8, 1991

[51] Int. Cl.[5] ..... A63B 67/00

[52] U.S. Cl. ..... 273/55 R

[58] Field of Search ..... 273/55 R, 55 B; 272/76, 272/77, 78

[56] References Cited

U.S. PATENT DOCUMENTS

| | | | |
|---|---|---|---|
| 1,962,088 | 6/1934 | Crowther | 273/55 R |
| 2,037,508 | 4/1936 | Gilman | 273/55 A |
| 2,237,599 | 4/1941 | Gilman | 273/55 A |
| 2,237,600 | 4/1941 | Gilman | 273/55 R |
| 2,620,188 | 12/1952 | Malagio | 273/55 A |
| 2,913,245 | 11/1959 | Landis | 273/55 A |
| 2,929,629 | 3/1961 | Feula | 273/55 R |
| 2,934,343 | 4/1960 | Schumacher | 273/55 R |
| 3,216,724 | 11/1965 | Williams | 273/55 R |
| 3,416,795 | 12/1968 | Lewis et al. | 273/55 A |

*Primary Examiner*—Theatrice Brown

*Attorney, Agent, or Firm*—H. Jay Spiegel

[57] ABSTRACT

Disclosed is a tackling practice machine designed to be used by football players to practice tackling technique. The machine includes a frame and an adjustable upright designed to removably carry a pad. The frame includes two lateral upwardly extending members which are sized and configured so that when the machine is tackled, it is supported on one of these members so that in conjunction with the particular design of the frame and upright as to center of gravity, the machine will automatically pop up and be ready for the next player.

7 Claims, 4 Drawing Sheets

POP-UP TACKLING PRACTICE MACHINE

BACKGROUND OF THE INVENTION

The present invention relates to a pop-up tackling practice machine. In the prior art, tackling practice machines are known and generally include a frame having an upright carrying a pad. Such machines are designed to be used to practice tackling technique and players are taught to lift the machine and turn it over on its side thus "tackling" it. Once this maneuver has been performed, however, the machine must be manually lifted back to an upright position and positioned for the next player.

The following prior art is known to Applicant:

U.S. Pat. No. 2,620,188 to Malagio discloses a resilient bag support having a frame with two skids, upright structure and a pad resiliently mounted on a coil spring. This patent fails to teach or suggest the concept of the ability to turn the machine on its side and the subsequent automatic righting of the machine.

U.S. Pat. No. 2,913,245 to Landis teaches an athletic tackling bag having an upstanding pad mounted in a stationary position on a ground surface with means including a spring bias cable. The present invention differs from the teachings of Landis as including a movable frame having mechanical structure on the frame designed to allow righting of the frame.

U.S. Pat. No. 2,934,343 to Schumacher discloses a football blocking and tackling practice machine including a frame and an upright pivotably mounted to the frame and spring biased in on direction. The upright has a pad removably attached thereto. Schumacher fails to teach or suggest the ability of the Schumacher device to automatically right itself.

U.S. Pat. No. 3,416,795 to Lewis et al. discloses an upright pad mounted in a stationary position on a base having spring biasing means allowing the pad to be tipped and thereafter to be restored to an upright position. Again, for the same reasons set forth above concerning the patent to Landis, the present invention clearly distinguishes from Lewis et al.

SUMMARY OF THE INVENTION

The present invention relates to a pop-up tackling practice machine. The present invention includes the following interrelated objects, aspects and features:

(a) In a first aspect, the present invention includes a generally rectangular frame having a central support of U-shaped cross section surrounded by tubular frame members. One end of the central support has attached thereto an upright while the other end of the central support is turned slightly upwardly as are the tubular frame members in that area to prevent the forward end of the frame from digging into the ground when the inventive practice machine is being used.

(b) The upright is preferably bolted to the central support and has two adjacent rows of holes designed to allow attachment thereto of a pad support. There are sufficient numbers of holes in the upright to allow easy adjustability of the height of a pad which may be releasably secured to the pad support.

(c) Two of the tubular frame members are side members. To these side members are attached upstanding inverted U-shaped members which are angled to a side of vertical away from the central support in a symmetrical fashion, with respect to a ground surface on which the tackling practice machine sits.

(d) The inventive tackling practice machine is designed as to center of gravity, and the size and configuration of the upstanding inverted U-shaped members are so designed that when the inventive machine is tipped to one side, it is at least partially supported on one of the upstanding inverted U-shaped members and in a configuration whereby the center of gravity of the machine causes the machine to pop back up to an upright position when released thereafter.

As such, it is a first object of the present invention to provide a pop-up tackling practice machine.

It is a further object of the present invention to provide such a machine including an upright having a pad support of adjustable height.

It is a further object of the present invention to provide such a machine having upstanding inverted U-shaped members mounted on side members of the frame thereof to cause the inventive machine to pop up to an upright position after being "tackled".

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 5:
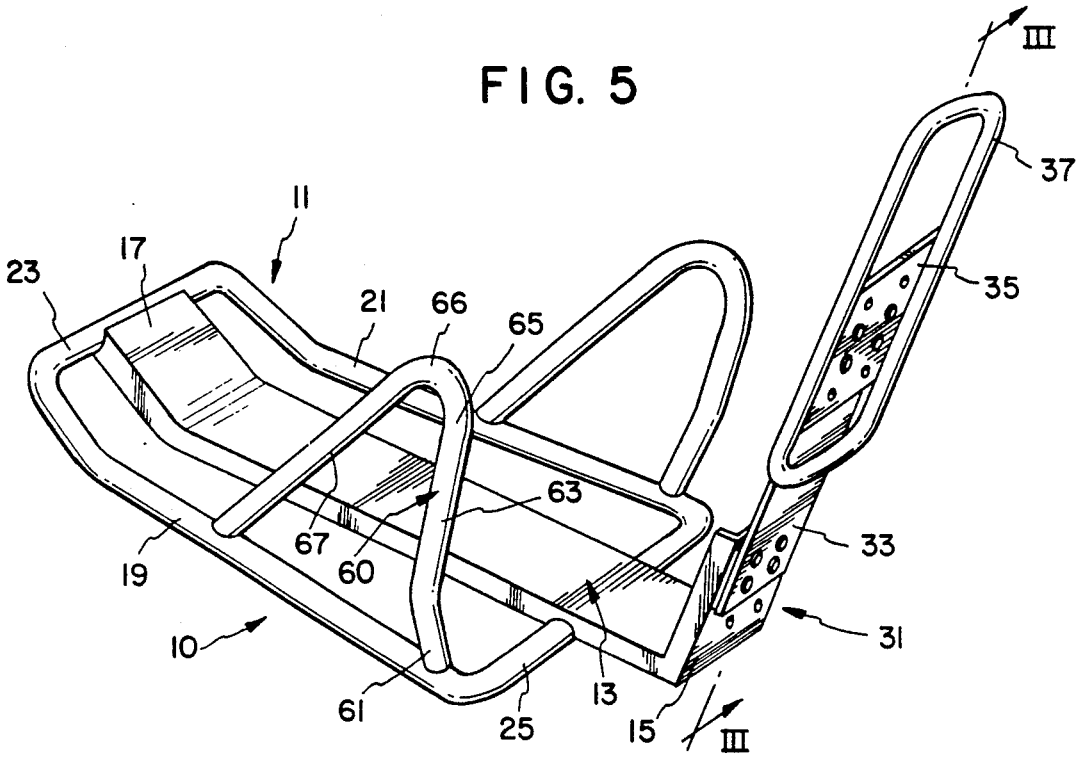
FIG. 5 shows a rear lateral perspective view of the present invention from a perspective different from that which is shown in FIG. 1 and with the pad of the inventive machine removed for clarity.

With reference to the figures, especially FIG. 5, the inventive machine is generally designated by the reference numeral 10 and is seen to include a frame 11 and an upright 31. The frame 11 includes a central support 13 which has a U-shaped cross section as best seen from the view of the underside thereof in FIG. 6. One end of the central support 13 is bent generally perpendicular thereto and is generally designated by the reference numeral 15. The other end of the central support 13 is designated by the reference numeral 17 and defines with the central support an obtuse angle. The upright 31 is attached to the said one end 15 of the central support in a manner to be described in greater detail hereinafter.

The frame 11 also includes side members 19, 21, an end member 23 and two short members 25 and 27. If desired, these tubular members 19, 21, 23, 25 and 27 may be made of a single tube bent into the configuration shown in the drawing figures and suitably attached to the central support 13 by means such as, for example, welding or bolting or both. In such case, the single piece consists of portion 25 attached to portion 19 attached to portion 23 attached to portion 21 attached to portion 27, in that order.

Figure 7:
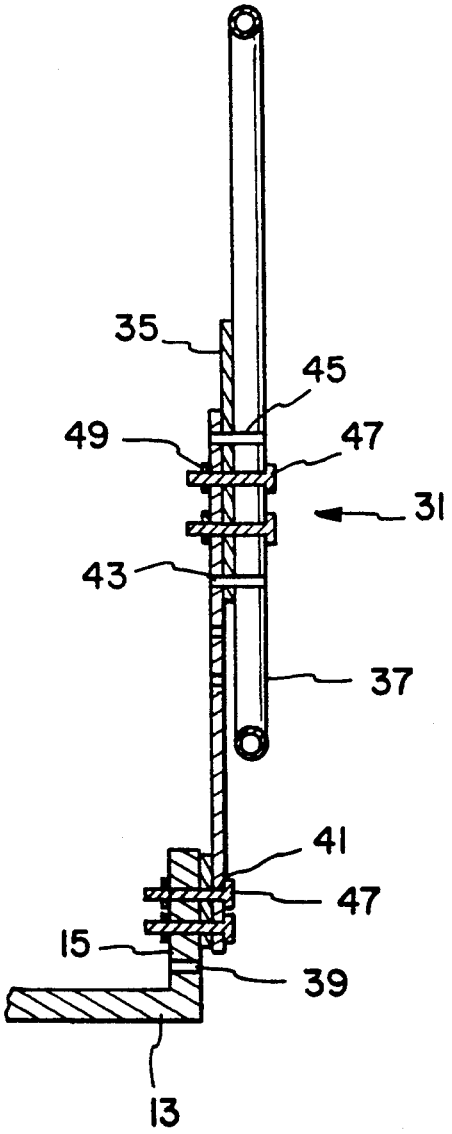
FIG. 7 shows a cross-sectional view along the line VII—VII of FIG. 5.

With particular reference to FIGS. 5 and 7, attached to the said one end 15 of the central support 13 is the upright 31. The upright 31 includes a first plate 33 attached to the one end 15, a second plate 35 attached to the first plate 33 and a loop-like support member 37 attached to the second plate 35. With particular reference to FIG. 7, is seen that the one end 15 has two rows of three holes 39 with the first plate 33 having two rows of two holes 41 so that adjustability of the elevation of the upright with respect to the one end 15 may be made. Furthermore, at an upper end of the first plate, two rows of six holes 43 are provided with the second plate 35 having two rows of four holes 45 allowing further adjustability of the elevation of the second plate 35 and thereby the pad support 37. The pad support 37 is attached to the second plate 35 by any suitable means including welding beads.

With further reference to FIGS. 5 and 7, it is seen that bolts 47 which are suitably threaded and nuts 49 threadably mounted thereon are used to fasten the upright 31 in a desired degree of elevation of the pad support 37.

As seen in FIGS. 1, 2, 3, 4 and 6, the pad 50 includes a body portion 51, two laterally extending portions 53, 55 and a neck portion 57. The pad 50 is designed to resemble the torso of a human being to add realism to the tackling practice procedure. The pad 50 has an internal recess (not shown) designed to allow easy mounting of the pad 50 over the pad support 37 merely by dropping the pad 50 over the pad support 37.

With further reference to FIGS. 1-6, it is seen that the side members 19, 21 of the frame 11 are angled upwardly in correspondence to the upward angling of the end 17 of the central support in the region of the member 23. Thus, the inventive frame 11 has an upturned end designed to prevent the machine 10 from plowing into the ground when it is being moved by a player during tackling practice.

With particular reference to FIGS. 1-6, it is seen that the side member 19 has a righting means consisting of an upstanding inverted U-shaped member 60 mounted thereon including a first leg 61 angled outwardly with respect to the central support 13, a vertically extending leg 63, a curved leg 65 extending to an apex 66 and a straight leg 67 angling from the apex 66 directly down to the side member 19. In a similar and symmetric way, with particular reference to FIG. 1, the side member 21 has mounted thereto a further righting means consisting of an upstanding inverted U-shaped member 70 having a first leg 71 angled outwardly with respect to the central support 13, a second leg 73 extending generally vertically, a curved leg 75 extending to an apex 76 and a straight leg 77 extending from the apex 76 back down to the side member 21.

Figure 1:
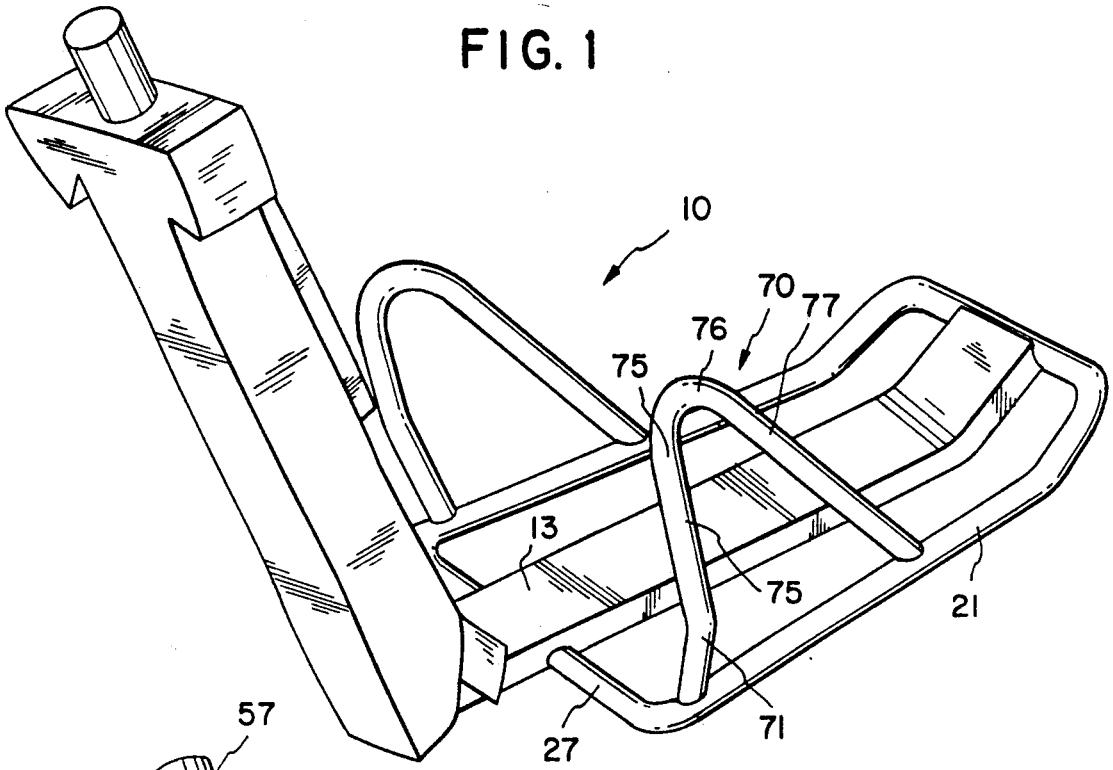
FIG. 1 shows a rear lateral perspective view of the present invention.
Figure 2:
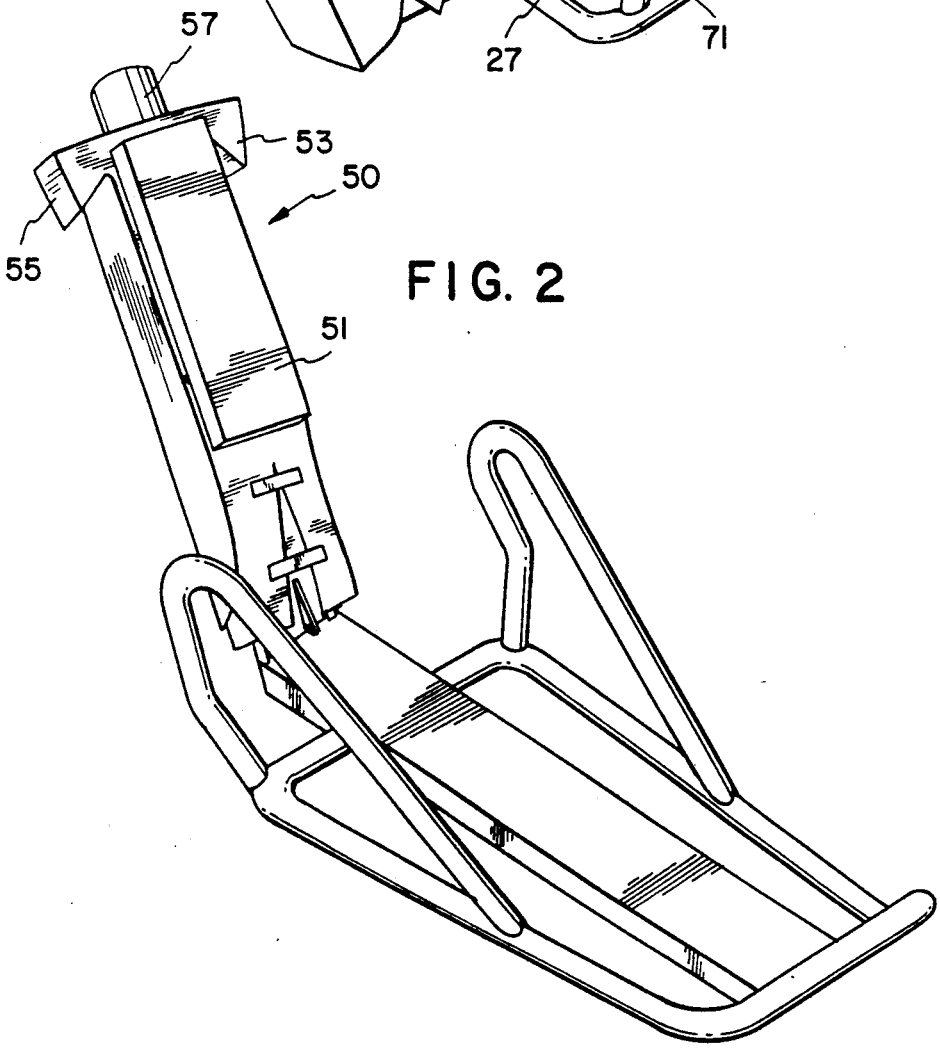
FIG. 2 shows a front lateral perspective view of the present invention.
Figure 3:
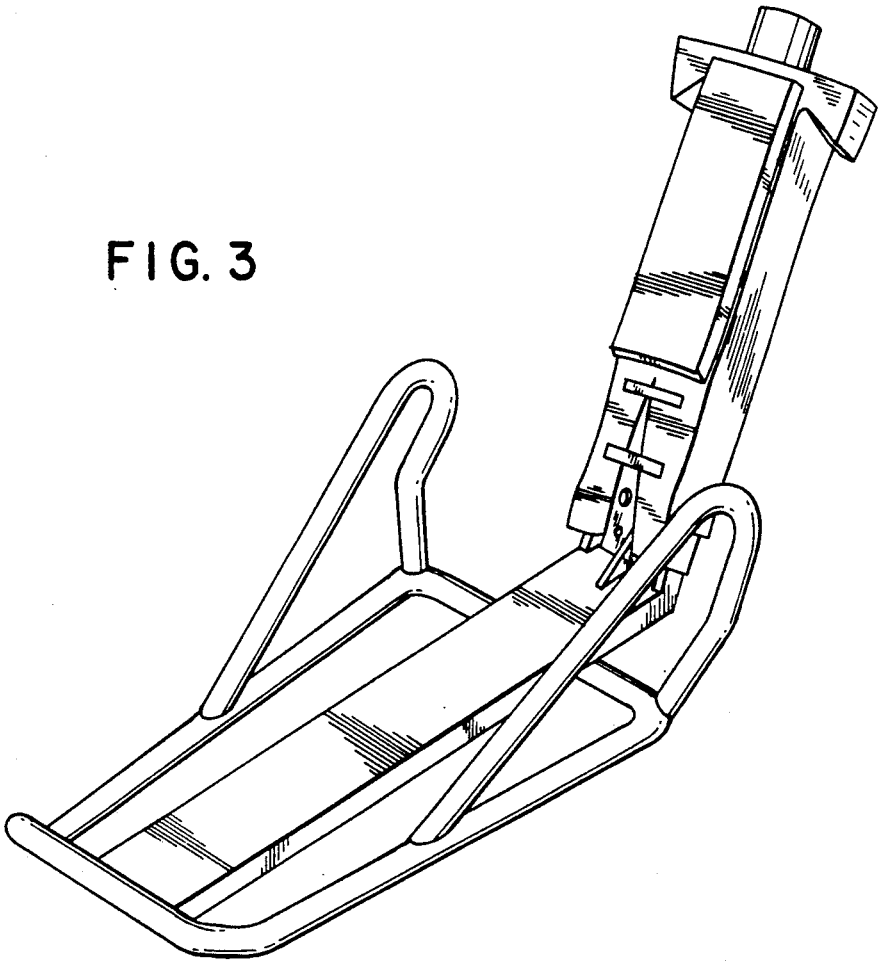
FIG. 3 shows a front lateral perspective view from another perspective from the one shown in FIG. 2.
Figure 4:
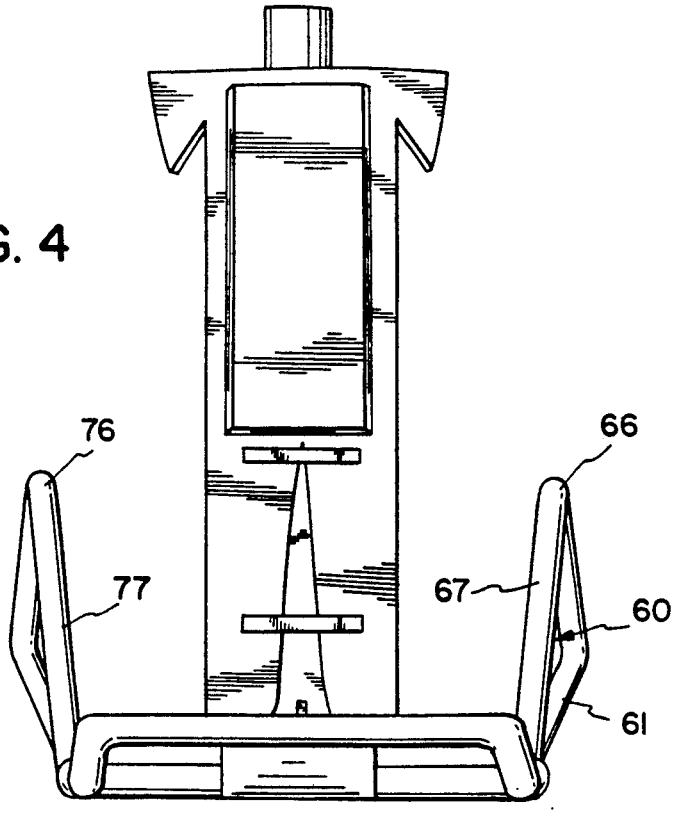
FIG. 4 shows a front view of the present invention.

With particular reference to FIG. 4, it is seen that the legs 67, 77 are angled slightly away from the frame 11 with respect to the central support 13 thereof, with the legs 63, 73 being slightly outside the legs 67, 77 respectively.

Figure 6:
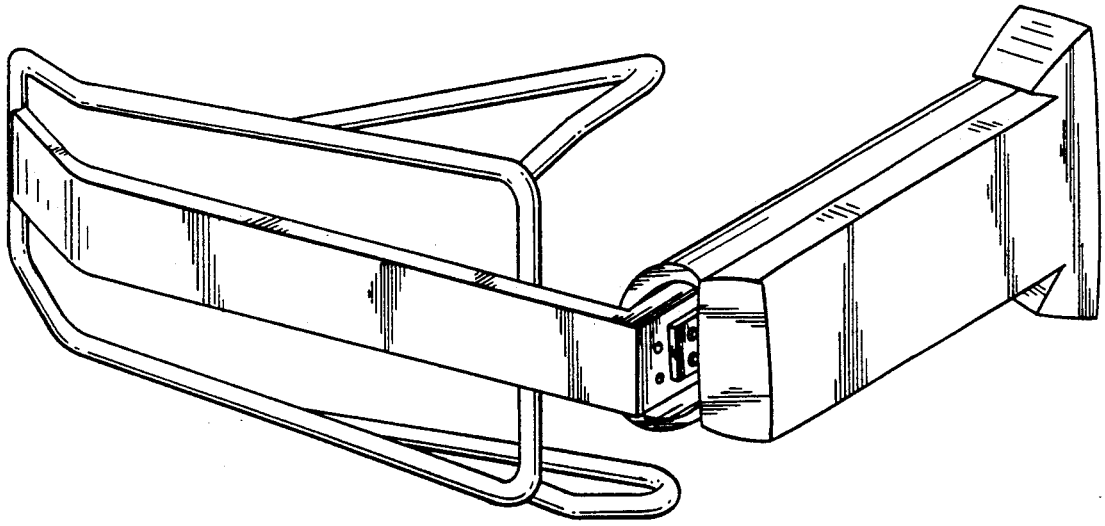
FIG. 6 shows a perspective view of the inventive machine from the side and showing the machine tipped over onto one of the upstanding inverted U-shaped members thereof.

The members 60, 70 are located on the side members 19 and 21, respectively and are sized, configured and angled when taken in conjunction with the center gravity of the inventive device 10 with the pad 50 mounted thereon such that when the tackling practice machine 10 is tipped to its side as shown in FIG. 6, the tackling practice machine 10 will have a tendency to pop up to the upright position shown in FIGS. 1-5. Extensive testing of a prototype of the inventive machine 10 has revealed that invariably when the machine 10 is tackled by a player and thereby pivoted to a position such as that which is illustrated in FIG. 6 or, alternatively to a position tipped to the opposite side thereof, after the machine is released by the player, the machine will right itself to the upright position illustrated in FIGS. 1-5 so as to be ready for the next player.

In the preferred embodiment of the present invention, the members 19, 21, 23, 25, 27, 60 and 70 are made of metallic tubing.

As such, an invention has been disclosed in terms of a preferred embodiment thereof which fulfills each and every one of the objects of the invention as set forth hereinabove and provides a new and improved pop-up tackling practice machine which fulfills each and every one of the objects of the invention as set forth hereinabove and provides a new useful and effective machine.

Of course, various changes, modifications and alternations in the teachings of the present invention may be contemplated by those skilled in the art without departing from the intended spirit and scope thereof. As such, it is intended that the present invention only be limited by the terms of the appended claims.

I claim:

1. In a tackling practice machine having a frame with at least one side member and an upright mounted on said frame, and carrying a pad, the improvement comprising righting means for righting said machine comprising an upstanding member mounted on said side member and extending upwardly with respect to said frame whereby when said machine is tackled by pivoting said machine so as to be in a position supported at least in part by said upstanding member, the size and configuration of said upstanding member, and pad in conjunction with a location of a center of gravity of said machine will result in said machine automatically righting itself to a position whereby said machine is supported solely by said frame.

2. The invention of claim 1, wherein said frame includes a further side member symmetric with said side member, first mentioned, and further comprising further righting means for righting said machine comprising a further upstanding member mounted on said further side member and symmetric with said upstanding member, first mentioned.

3. The invention of claim 2, wherein said upstanding member and further upstanding member are each generally in the shape of an inverted "U" and are each angled slightly outwardly with respect to a centerline of said frame.

4. The invention of claim 3, wherein said side member, said further side member, said upstanding member and said further upstanding member are all made of metallic tubing.

5. The invention of claim 1, wherein said upright includes a plate adjustably mounted to said frame and a pad support adjustably mounted to said plate, said pad being placed over said pad support.

6. The invention of claim 1, wherein said upstanding member is generally in the shape of an inverted "U" and is angled slightly outwardly with respect to a centerline of said frame.

7. The invention of claim 1, wherein said pad is made to resemble a human torso.

* * * * *